United States Patent [19]

Garbini

[11] Patent Number: 4,580,483

[45] Date of Patent: Apr. 8, 1986

[54] WEAPON REST FOR RIFLES AND THE LIKE

[76] Inventor: Louis K. Garbini, St. Galler Strasse 72, CH-9325 Roggwil TG, Switzerland

[21] Appl. No.: 716,474

[22] Filed: Mar. 26, 1985

Related U.S. Application Data

[63] Continuation of Ser. No. 405,569, Aug. 5, 1982, abandoned.

[30] Foreign Application Priority Data

Aug. 7, 1981 [DE] Fed. Rep. of Germany ..... 3131383

[51] Int. Cl.[4] ..... F41C 29/00

[52] U.S. Cl. ..... 89/40.06; 42/94; 248/165

[58] Field of Search ..... 89/37.04, 40.06; 248/163 R, 165, 188, 188.7, 168, 169, 432; 211/203, 63; 42/94

[56] References Cited

U.S. PATENT DOCUMENTS

| | | | |
|---|---|---|---|
| 478,233 | 7/1892 | Hewitt | 248/432 X |
| 1,448,171 | 3/1923 | Waderlow | 248/165 X |
| 2,779,390 | 1/1957 | Freeman | 248/165 X |
| 2,865,133 | 12/1958 | Hoven | 248/188.9 |
| 2,919,093 | 12/1959 | Mooney | 248/188 X |
| 3,178,143 | 4/1965 | Gustin | 248/188 X |
| 3,233,517 | 2/1966 | Morrison | 89/37 BA |
| 3,358,504 | 12/1967 | Freebairn | 89/37 BA X |
| 4,208,946 | 6/1980 | Van Sickle | 89/37 BA |
| 4,300,851 | 11/1981 | Thelander | 248/188 X |

FOREIGN PATENT DOCUMENTS

| | | | |
|---|---|---|---|
| 71887 | 2/1983 | European Pat. Off. | 42/94 |
| 1108937 | 9/1955 | France | 248/168 |
| 677305 | 8/1952 | United Kingdom | 248/168 |

*Primary Examiner*—Stephen C. Bentley
*Assistant Examiner*—John S. Maples
*Attorney, Agent, or Firm*—Boniard I. Brown

[57] ABSTRACT

A weapon rest is provided for rifles and the like, which has a support section, and a body carrying the support section. The body defines a central recess and a plurality of blind holes extending radially outwardly from the central recess and communicating with the central recess. A plurality of legs are engageable in the blind holes, and central lock apparatus in the central recess is adapted to engage the legs to releasably secure them in the body. Each of the legs may have a reduced portion for engagement with the central lock apparatus. The central lock apparatus may include, in different embodiments, various features for engaging the legs.

5 Claims, 10 Drawing Figures

WEAPON REST FOR RIFLES AND THE LIKE

This is a continuation of co-pending application Ser. No. 405,569 filed on Aug. 5, 1982 now abandoned.

SUMMARY AND BACKGROUND OF THE INVENTION

The object of the invention is a weapon rest for a rifle or the like with a part carrying the rifle stock which attaches to a body that is supported on the ground by means of feet.

The invention has made it its task to configure a weapon rest in such a manner as to create a small and light weapon rest with low transport weight which would fit into any weapon case built for the rifle, for example, and can even be worn in the clothing, yet offers the rifle placed upon it excellent anchoring with the ground.

To fulfil the proposed task, the invention is characterized in that it features a central recess into which several blind bores cut, which point radially outward at an angle with the horizontal and in that the head of a support leg can be axially pushed into each blind hole where it can be arrested, at least against axial movement, with a central adjustable lock that is mounted in the central recess.

A key characteristic, therefore, is the central lock which is mounted in the body of the weapon rest and which provides a releasable connection between the support legs and the body of the weapon rest, such that the support legs can be removed from the body with a single operation of the central lock for storage separate from the body, e.g. in the weapon case.

The connection of the legs with the body is extremely simple, since each leg is pushed head first into the blind hole in the body and—when this insertion has been accomplished with all legs—the central lock is actuated with a single rotary movement so that all legs are axially locked into the body.

Using a central lock in the body therefore offers the advantage that the legs can all be removed from the body with a single operation of the central lock, which provides for rapid assembly and disassembly.

The central lock may be made up in several embodiments.

A first embodiment provides for the central lock to consist of a set screw that can be screwed into the central recess by means of threads. An edge of the screw fits into a reduced diameter neck at the head of the support leg. When the set screw is screwed into the threads of the central recess its edge is pressed into a reduced diameter neck at the bottom of the central recess, so that the support leg is axially locked.

A second embodiment provides for the central lock to consist of a cover plate that is screwed into the central recess by threads and which bears several balls at its inner end, each of which reaches into the blind hole provided for the head of the support leg and that the balls are radially pressed outward by a tension ring against the inner perimeter.

This embodiment does not use any set screw, but balls that are radially pressed outward by a tension ring and which are pressed into a reduced diameter neck at the head of the support leg. A catch connection is thus provided between the head of the support leg and the central lock so that both the assembly and the disassembly are accomplished by means of the cited catch lock. There is no need to activate a set screw.

The third embodiment provides for the central lock to consist of a mounting ring that is threaded into the central recess and through whose central bore a twist lock passes which engages the neck at the head of the support leg by means of a rotary, axially spring loaded cam ring.

In this embodiment a cam ring is used which features radially projecting cams which press into the reduced diameter neck at the head of the support leg. By a turn of the cam ring recesses with a reduced radial distance from the axis of rotation are moved into the region of the neck at the head of the support leg, so that the support leg can be pulled from the blind hole in the body.

It is of special advantage if the cam ring is axially spring loaded against the neck of the support leg, because this locks the support leg not only against axial movement but against turning as well. The cited cam ring may also be called an eccentric twist lock, because the radially projecting cams, which engage the neck at the head of the support leg, are at a different radial distance from the rotary axis of the cam lock than the recesses of reduced radial distance that follow the projecting cams in peripheral direction.

In the first and third examples of the embodiments an operating element (central lock) must be turned. In order to make this turn simple and operationally secure, a so-called ball index is provided, which consists of a spring loaded ball which rests in a recess in the body in the locked position of the central lock. This stop gives the central lock a definite locked and a definite open position.

The arrangement of the longitudinal holes, radially distributed about the perimeter of the central recess, is arbitrary. In the context of the present invention a number of five blind holes is preferred. This provides numerous combinations, since a weapon rest can be set up with three support legs, with the three support legs being inserted into the five blind holes at will. Instead of a tripod, a bipod can also be set up, in which case the five blind holes provide even more combinations.

It is preferred that the longitudinal axis of the support legs, and hence of the blind holes, form an angle of about 50 degrees from the horizontal, because this provides a particularly positive transfer of forces from the support legs to the ground. But angles between 30 and 80 degrees are possible.

Regarding the arrangement of several blind holes, it is also possible that three blind holes be provided at one angle of the longitudinal axis with respect to the horizontal, for example, while the longitudinal axis of other blind holes forms a different angle with the horizontal.

It was initially explained that positive force transfer from the gun rest to the ground is important. The special configuration of the ground end of the support leg also serves to fulfil this function, featuring a length adjustable steel tip according to the invention.

It is practical to enclose the steel tip with a removable rubber foot and that the contact surface of the rubber foot closest to the ground forms an angle with respect to the horizontal.

The cited features provide the additional advantage that additional precision horizontal leveling of the weapon stand with the weapon and the sighting telescope is provided by means of an adjustable steel tip with rubber foot. The rubber foot can be directly pulled off as needed, e.g. when shooting on very hard, slippery terrain.

This rubber foot clearance of about 5 degrees provides an extremely skid resistant, shock absorbing effect, as well as a high degree of stability for the weapon stand with the precision weapon, e.g. on smooth surfaces such as plastic surfaces, i.e. office tables or aluminum window sills with anodized or hard surfaces, or on window sills made of steel or scratch-resistant polymer laquers or powder coating.

The rubber feet offer the additional advantage of not marring when shooting from office tables and of making no noise in handling.

When the rubber foot is placed on the ground, the contact surface closest to the ground forms a slight angle with the horizontal, e.g. 5 degrees. When a shot is fired, the angle of the longitudinal axis of the support foot is reduced with respect to the horizontal, because the support legs are radially spread out due to the transmitted recoil, which places the contact surface next to the ground in total surface contact with the ground, producing a braking effect and shock absorption. This prevents excessive spreading of the support legs, and the support head mountings in the blind holes suffer only little bending stress. The central lock can therefore be designed to be particularly light and simple, because avoiding excessive spreading of the support legs by means of the arrangement of a rubber foot with a contact face clearance provides a brake and shock absorbing effect when a shot is fired.

The subject matter of the present invention is a function not only of the subject matter of the individual patent claims, but also of the combination of the various patent claims.

All of the data and characteristics revealed in the documents, particularly the spatial configuration illustrated in the drawings, are claimed as being essential to the invention, insofar as they are new to the state of the art, individually or in combination.

DESCRIPTION OF THE PREFERRED EMBODIMENT

Figure 1:
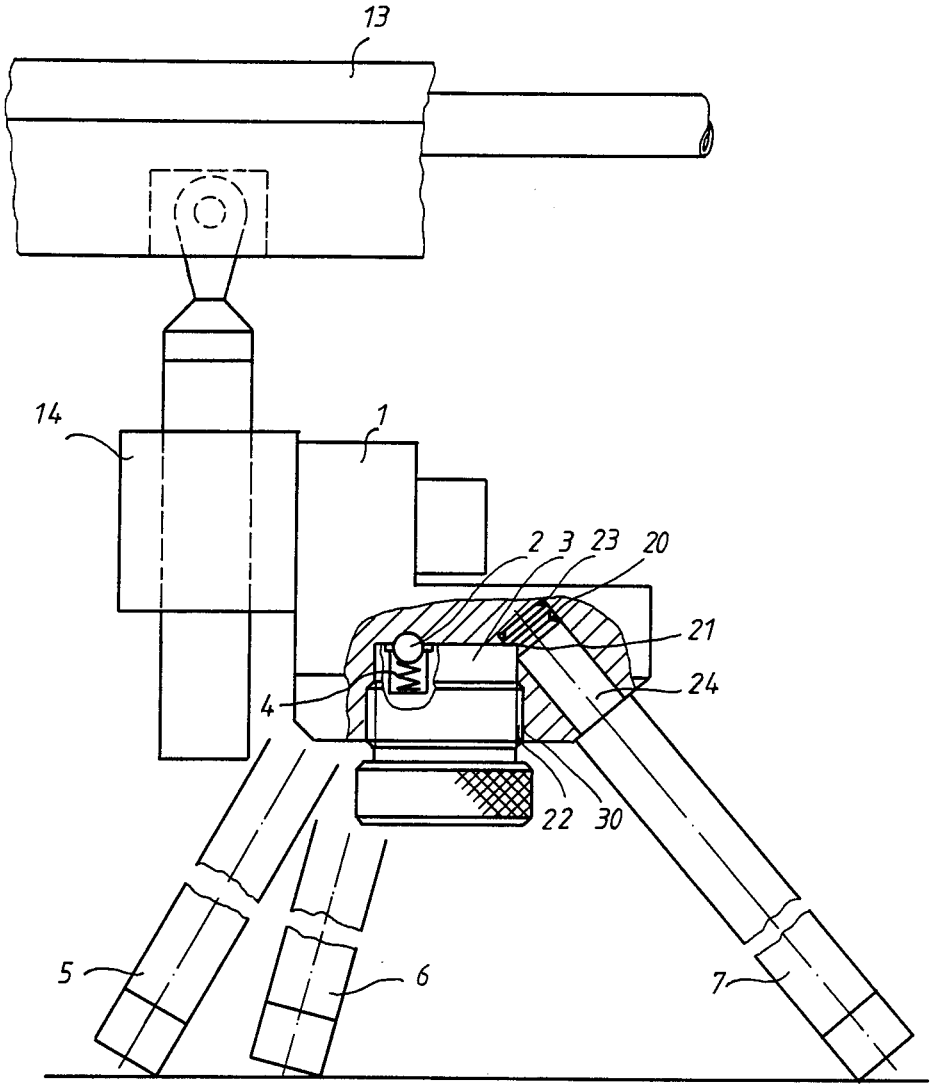
FIG. 1 is a schematic side view with partial section through the weapon rest according to the invention in its first embodiment.

In FIG. 1 the stock of a weapon 13 rests on a support bolt, which is in turn supported by a pivot section 14 of the weapon rest. The support bolt which carries the weapon 13 is axially adjustable within the pivot section 14, while the pivot section 14 can be radially rotated in the body 1 of the weapon rest.

A central recess 30 is provided in the underside of the body 1, into which blind holes 23,28 (cf. FIGS. 3*b* and 4 to 8) are cut obliquely (e.g. at an angle of 50° from the horizontal). The floor of the inside perimeter of the central recess 30 has openings due to the oblique cutting of the blind holes 23 with respect to the longitudinal axis of the recess 30. When a head 24 of a support leg 7 is pushed into the corresponding blind hole 23, a reduced diameter neck portion 20 comes to rest in the region of the central recess 30.

The central recess 30 has an internal threaded 22, which engages the external thread of a corresponding set screw 3. The set screw 3 has a front edge 21 which clamps into the neck 20 of the head 24 of the support leg 7 when the set screw 3 is screwed into the thread 22.

In order to keep from having to completely unscrew the set screw 3, a ball detent 2 is provided, consisting of a spring loaded ball, which is under axial pressure from a compression spring 4. It is sufficient to loosen the set screw 3 a single turn to remove the edge 21 from its engagement with the neck 20 of the head 24 of the support leg 7, so that the support leg 7 can be pulled axially from the blind hole 23.

In the locked position, when the edge 21 of the set screw 3 rests in the neck 20 of the support leg 7, the ball of the ball stop rests in the catch 2 (cf. FIG. 1) and the locked position is thus defined.

The remaining support legs 5 and 6 are fixed in the same manner.

By loosening of the set screw 3 all support legs 5,6,7 can be pulled out at once and can be reinserted and locked with a single movement.

Figure 2:
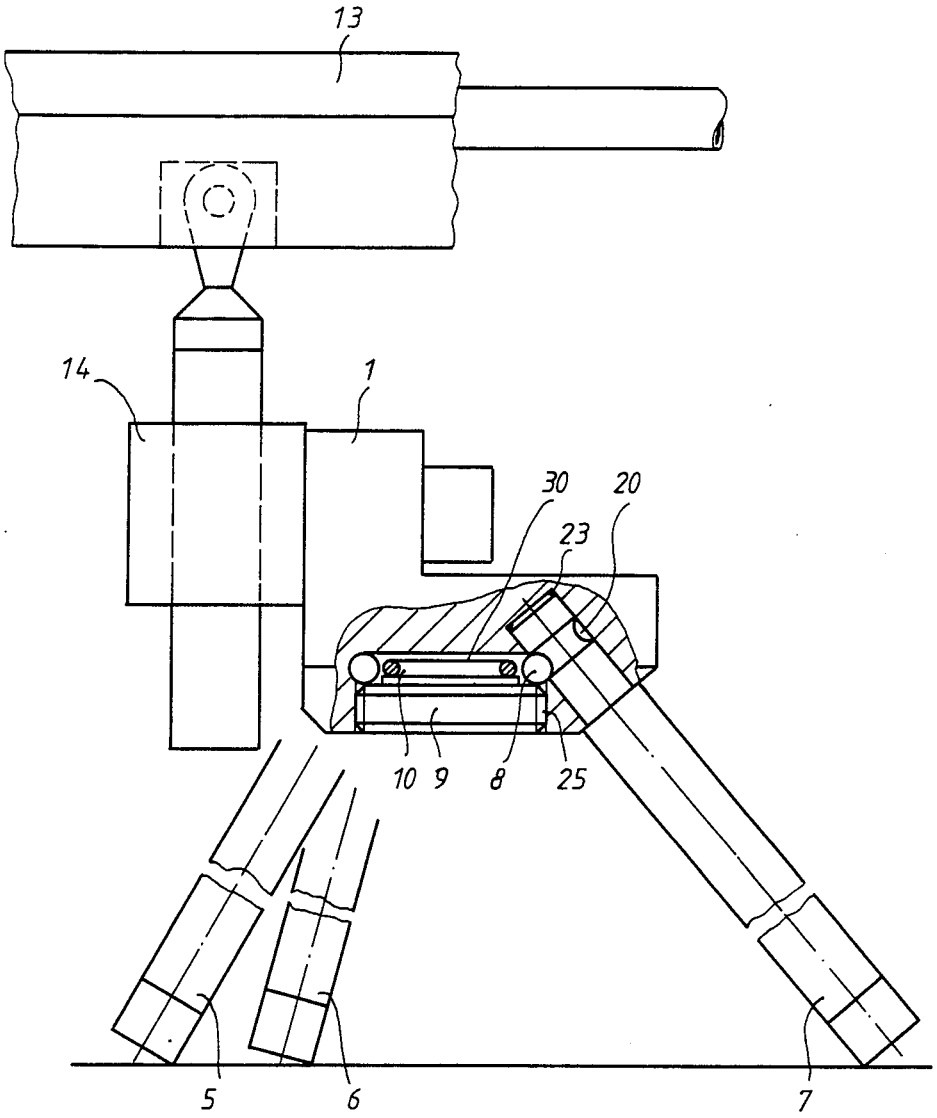
FIG. 2 is a side view with partial section through a second embodiment.

FIG. 2 shows a second embodiment of a central lock. Here the central lock consists of a terminal bolt 9 which screws into threads 25 of the central recess 30 and whose front end carries balls 8, each of which is allocated to one blind hole. A tension ring 10 is provided on a step of reduced diameter on the terminal bolt 9, which forces the balls radially outward. This presses the balls 8 into the reduced diameter neck 20 of the support legs 5,6,7, which locks the support legs. This type of assembly eliminates manual operation of a central lock, because the support legs 5,6,7 need only be pushed in or pulled out and always engage the balls 8 in the locked position.

Figure 3A:
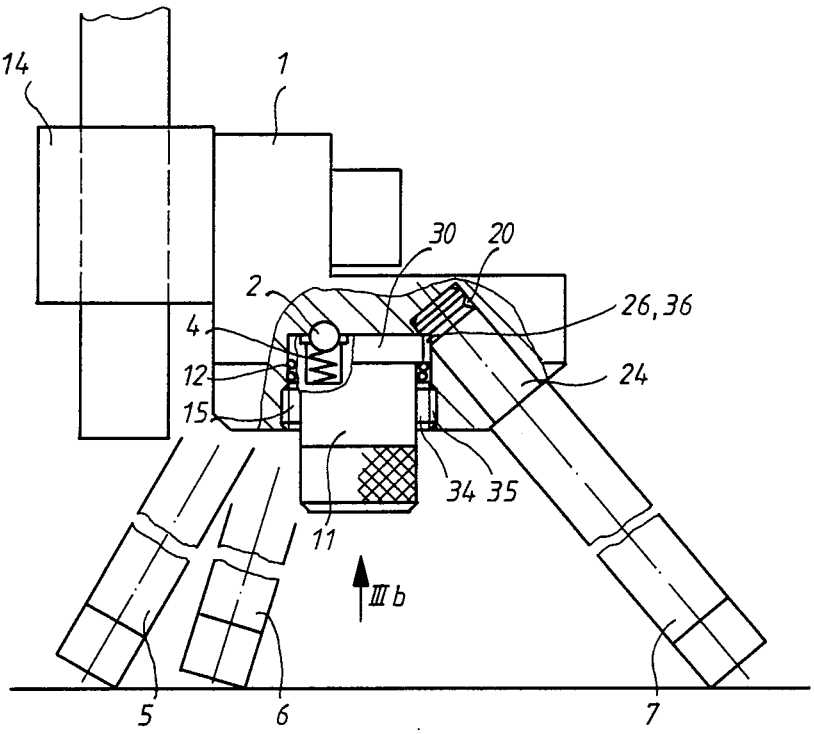
FIG. 3*a* is a side view with partial section through a third embodiment.
Figure 3B:
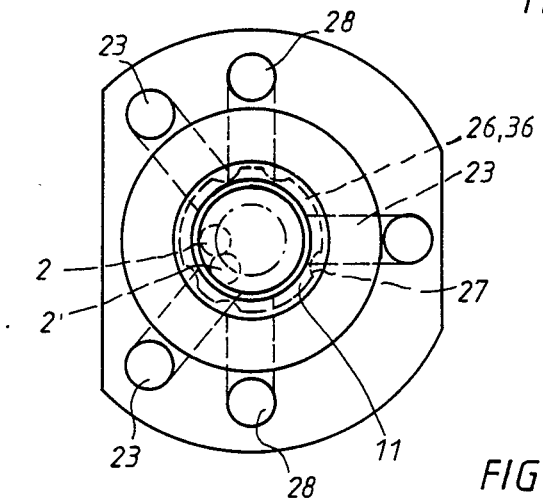
FIG. 3*b* is a view in the direction of the arrow IIIb according to FIG. 3*a;*

FIGS. 3*a* and 3*b* show a third embodiment, in which a seal ring 15 is screwed into the threads 35 of the central recess 30. The cam shaped twist lock 11, made of a single piece of material that incorporates a cam ring 36 at its bottom end, reaches through the central bore 34 of the seal ring 15. The cam ring 36 can be rotated and is axially spring loaded against the neck 20 of the head 24 of the support legs 5,6,7 by the compression spring 12. In accordance with FIG. 3*b* the cam ring 36 has locking cams 26 distributed radially about its perimeter which, in the locked condition (see FIG. 3*a*), engage the reduced diameter neck 20 of the respective support leg 5,6,7.

When the twist lock is turned, cutouts 27 with reduced radial dimension from the rotary axis of the twist lock move into the area of the respective neck 20 of the support leg, so that the support leg can be pulled out.

A ball catch 2 is again provided to define the open position and the locked position of the twist lock 11, FIG. 3*b* illustrating an open position (ball catch 2) and a locked position (ball catch 2').

A locking cam 26 and a cutout next to it in peripheral direction are associated with each blind hole 23,28.

FIGS. 4 to 8 illustrate various insertion possibilities for the support legs 5,7.

Figure 4:
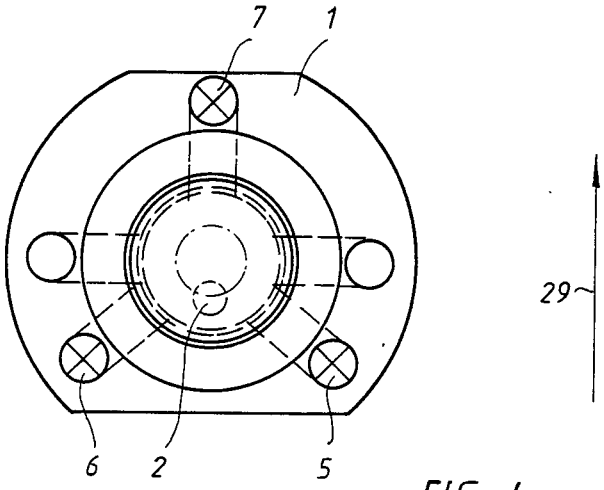
FIG. 4 is a bottom view of the body of the weapon rest in tripod configuration.
Figure 5:
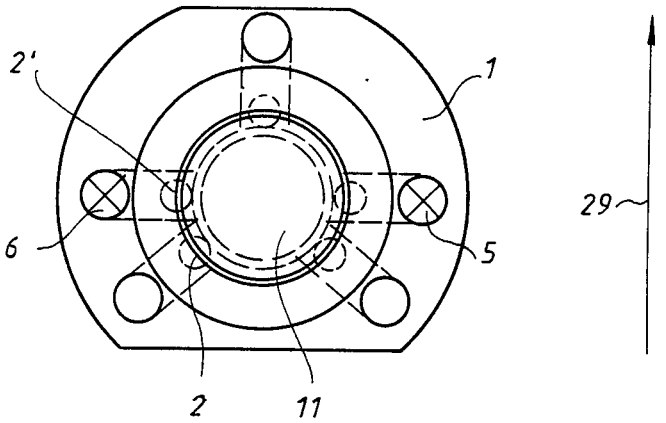
FIG. 5 is a view like that of FIG. 4, showing the weapon rest in bipod configuration.
Figure 6:
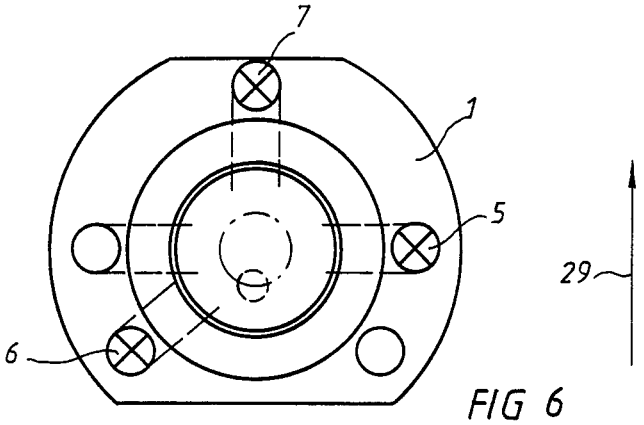
FIG. 6 is a view like that of FIG. 4, showing the weapon rest in a second tripod configuration.
Figure 7:
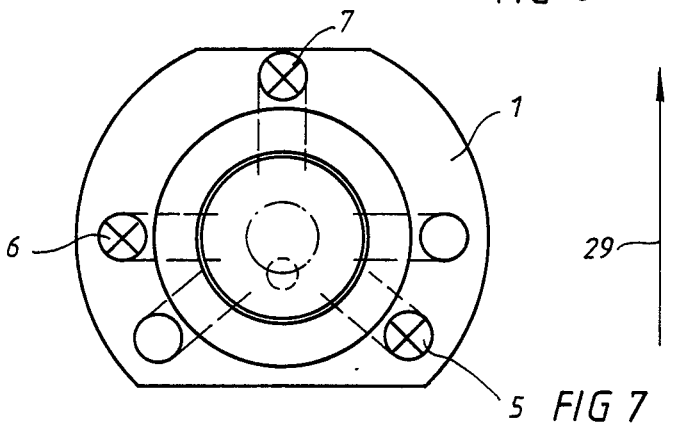
FIG. 7 is a view like that of FIG. 4, showing the weapon rest in another tripod configuration.
Figure 8:
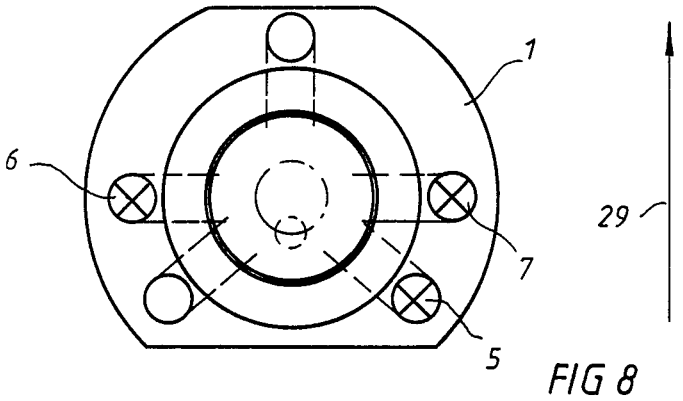
FIG. 8 is a view like that of FIG. 4, showing the weapon rest in a fourth tripod position.

FIG. 4 illustrates the insertion position for a tripod arrangement, while FIG. 5 illustrates the insertion position for a bipod. FIGS. 6 to 8 illustrate various asymmetrical insertion positions for tripod arrangements 5,6,7, and one can see that because of the various insertion options for the support legs the weapon rest can be adapted to various ground and firing conditions.

Further possibilities result from the provision of longitudinal axes of blind holes 28 (cf. FIG. 3*b*) at a different inclination to the horizontal than the longitudinal axes of blind holes 23.

The illustrations of FIGS. 4 to 8 also show that excellent support of the weapon rest on the ground is provided with regard to the direction of fire 29.

Figure 9:
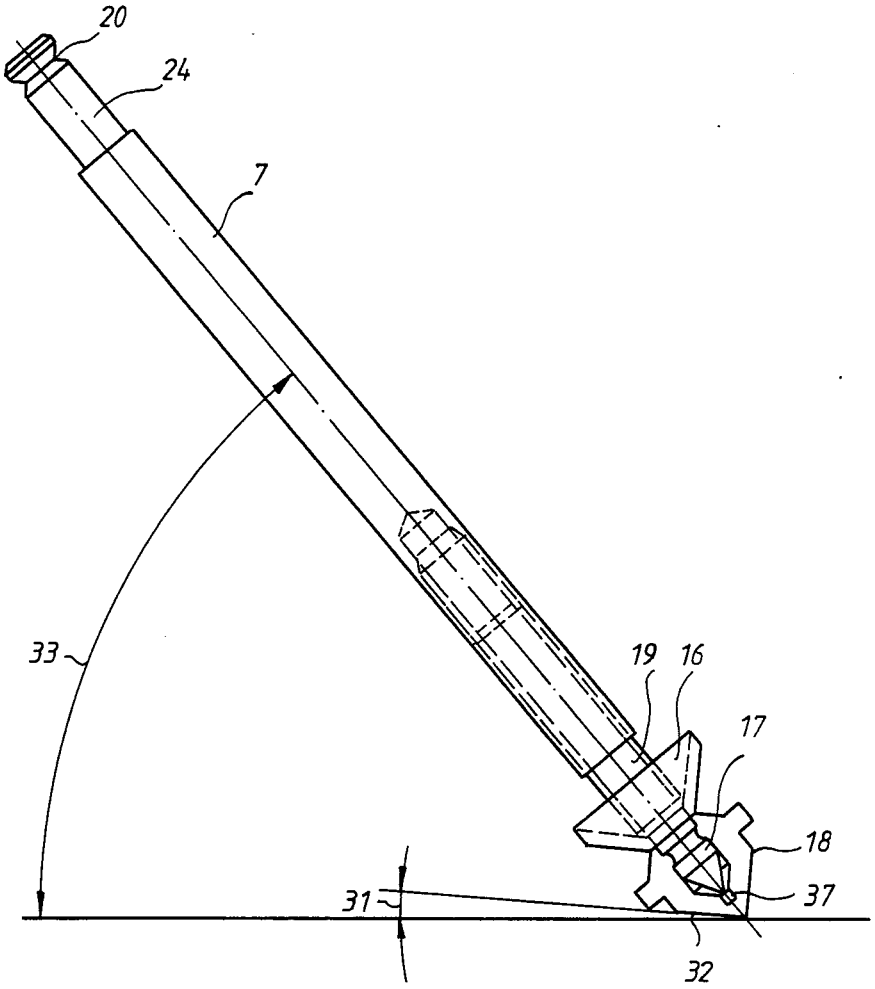
FIG. 9 is an elevational view of a support leg in service position, showing an adjustable tip and rubber foot utilized with the invention.

FIG. 9 illustrates the ground support of a support leg 7 with a steel tip 17 and an installed rubber foot 18. The steel tip 17 is mounted on a threaded bolt 19, whose outside thread engages a corresponding inside thread within the inner bore of the support leg 7. This provides for precision axial adjustment of the steel tip 17.

In order to prevent the steel tip 17 from penetrating into soft terrain, a conical disk 16 is pressed onto the steel tip 17. The conicity of the conical disk 16 is about 90 degrees, so is that of the tip of the rubber foot 18. The steel tip has a reduced diameter neck which fits into a peripheral rib within the rubber foot 18, providing a locking connection.

At the same time a blind hole 37 within the rubber foot 18 is provided for the steel tip 17, so that when a shot is fired and a force is axially directed into the support leg 7 and the rubber foot, the tip 17 is pressed into the blind hole 37, which radially expands the rubber foot 18. This brings the contact surface 32 nearest the ground into contact with the ground, braking the radial spreading of the support legs 5,6,7 on the ground. In its rest position the contact surface 32 forms a small angle 31 with the ground, e.g. an angle of 5 degrees.

The preferred angle 33 of the longitudinal axis of the support leg 5,6,7 with respect to the horizontal is 50 degrees. The rubber foot has a Shore hardness of 60 to 80.

The rubber foot 18 can be immediately pulled off, if needed.

It should also be pointed out that the thread 25,35 within the central recess 30 is a $\frac{3}{4}''$ gas pipe thread, so that spare parts procurement is very simple, because such threads and the corresponding central locking devices are easily obtained. A precision $26 \times 1.5$ thread may be use in lieu of of the cited thread.

The inventor claims:

1. A weapon rest for rifles and similar firearms comprising:

a support section for supporting the weapon, a body carrying the support section, said body defining a central recess and a plurality of cylindrical blind holes, each hole having an axis parallel to the walls of the hole, the holes being in communication with the central recess and extending radially outwardly therefrom, a plurality of support legs each having an indented portion adjacent an end wherein the end has a cross-sectional configuration along the region of the leg adjacent the end to accommodate effective sliding engagement into said blind holes wherein axial deflection of a leg relative to the axis of its receiving blind hole is substantially prevented by the close confinement of that region of the leg adjacent said end within the receiving blind hole, and central lock means mountable in the central recess for direct engagement with the indented portions of said legs to releasably secure the legs in the blind holes.

2. A weapon rest according to claim 1, wherein:

the number of said blind holes is five, and said holes are radially arranged about the perimeter of the central recess.

3. A weapon rest according to claim 1, and further including:

a steel tip adjustable in position axially of the leg at the end of each leg adjacent to the ground.

4. A weapon rest according to claim 1, wherein:

the central lock means comprises a set screw threadably engagable in the central recess and having an edge portion engagable with the indented portions of the legs to releasably secure the legs in the blind holes.

5. A weapon rest according to claim 4, wherein:

the rotational position of the central lock is set with a ball detent stop.

* * * * *